US008072410B2

(12) United States Patent
Park et al.

(10) Patent No.: US 8,072,410 B2
(45) Date of Patent: Dec. 6, 2011

(54) LIQUID CRYSTAL DRIVING DEVICE

(75) Inventors: Jung Kook Park, Kyoungki-do (KR); Seo Yoon Kim, Kyoungki-do (KR); Dae Yong Jang, Seoul (KR)

(73) Assignee: Hydis Technologies Co., Ltd., Gyeonggi-do (KR)

( * ) Notice: Subject to any disclaimer, the term of this patent is extended or adjusted under 35 U.S.C. 154(b) by 69 days.

(21) Appl. No.: 10/625,287

(22) Filed: Jul. 23, 2003

(65) Prior Publication Data

US 2004/0189583 A1 Sep. 30, 2004

(30) Foreign Application Priority Data

Mar. 31, 2003 (KR) ..... 10-2003-19940

(51) Int. Cl.
*G09G 3/36* (2006.01)

(52) U.S. Cl. ..... 345/100; 345/691; 345/692; 345/693

(58) Field of Classification Search ..... 345/100, 345/691–693
See application file for complete search history.

(56) References Cited

U.S. PATENT DOCUMENTS 6,717,559 B2 * 4/2004 Weindorf ..... 345/82
6,819,311 B2 * 11/2004 Nose et al. ..... 345/100
2003/0179173 A1 * 9/2003 Koyama et al. ..... 345/92

* cited by examiner

*Primary Examiner* — Ke Xiao
(74) *Attorney, Agent, or Firm* — William Park & Associates Ltd.

(57) ABSTRACT

Disclosed is an impulsive type liquid crystal driving device which inserts black data during a vertical blanking interval and then realizes motion picture, comprising: a liquid crystal panel for including a plurality of gate bus lines, which are arranged in one-direction, and a plurality of data bus lines which are arranged in a direction perpendicular to the plurality of gate bus lines; a gate driver section for sequentially scanning the plurality of gate bus lines during an active address interval in response to a second vertical starting signal, a vertical clock signal and an output enable signal, and scanning the plurality of gate bus lines during a vertical blanking interval in a unit of a predetermined number of lines; and a current boosting section for increasing current amount supplied to the gate bus lines during the vertical blanking interval in response to a pulse width modulation signal.

7 Claims, 7 Drawing Sheets

LIQUID CRYSTAL DRIVING DEVICE

BACKGROUND OF THE INVENTION

1. Field of the Invention

The present invention relates to a liquid crystal driving device, and more particularly to an impulsive type liquid crystal driving device which inserts black data during a vertical blanking interval and then realizes a motion picture.

The present invention is based on a system for displaying a motion picture by means of TFT-LCD (Thin Film Transistor Liquid Crystal Display) including a liquid crystal having a high response characteristic. In a liquid crystal driving device according to the present invention, a refresh rate may be set as 60 Hz in order to display the motion picture, but the refresh rate is not limited to that.

2. Description of the Prior Art

Generally, in a liquid crystal display device, an arrangement of liquid crystal molecules is changed by means of an electric field effect so that a light transmittance of the liquid crystal molecules is adjusted and thus an image is displayed. Further, liquid crystal display devices have developed from a TN-LCD type to a STN-LCD type, a MIM-LCD type and a TFT-LCD type, and display performance of liquid crystal display devices has remarkably improved. Since such liquid crystal display devices not only have low power consumption but also have compact sizes and small weights, they have attracted considerable attention as devices which can substitute for CRTs (Cathode Ray Tubes). Furthermore, as they have been widely utilized in notebooks and portable mobile communication devices, etc., demand for them has been on the rise.

A conventional liquid crystal driving device sequentially applies a gate on/off pulse from a first gate bus line to n-th gate bus line during one frame of a vertical sync (V_sync) and then sequentially scans the gate bus lines. Further, during an occurrence of a horizontal sync, the conventional liquid crystal driving device applies a data signal to each pixel of the gate bus line selected through a data bus line, and then displays one frame image by constantly maintaining the applied data signal. Such a liquid crystal driving method is called as "hold type".

A gate driver IC utilizing gate sequential scanning method according to the prior art is shown in FIG. 1.

Referring to FIG. 1, the conventional gate driver IC includes a plurality of shift registers SR1~SRn, a plurality of level shifters LS1~LSn and a plurality of buffer amplifiers BF1~BFn. The plurality of shift registers SR1~SRn receives a vertical starting signal STV in response to a vertical clock signal CPV and then sequentially shifts it to a next terminal in order to output it. The plurality of level shifters LS1~LSn are respectively coupled to the plurality of shift registers SR1~SRn, level-convert the output signals of the plurality of shift registers SR1~SRn and then output the level-converted signals. The plurality of buffer amplifiers BF1~BFn amplify the signals level-converted by the plurality of level shifters LS1~LSn and then output gate on/off signals G1~Gn.

Generally, it is preferred that a response speed of a liquid crystal is approximately 5 ms in order to reproduce a motion picture, but the response speed of liquid crystals have not been faster than the processing speed of image information in hold type liquid crystal display devices. Therefore, blurring due to image information from a prior picture remaining in the next frame may occur, thereby causing the degradation of the picture quality.

In order to improve such problems, a liquid crystal driving device, which utilizes an impulsive driving method of performing high-speed driving after dividing one frame, the refresh rate of which is 60 Hz, into an active address interval and blanking interval of 120 Hz, has been proposed. Herein, the impulsive driving method assigns a predetermined interval as a black image space in a unit of one frame in order to prevent image information in a prior frame from affecting a current frame.

However, in the conventional impulsive driving method, the blurring can't be completely removed, the occurrence possibility of EMI (Electro-magnetic interference) is high and the data maintenance time of a liquid crystal during the active address interval is short.

Also, in a case in which TV signals such as NTSC and PAL are reproduced, since one frame interval has been fixed as 16.7 ms, when an active interval is driven at 85 Hz in a liquid crystal driving device having an XGA grade, an activation interval of a vertical clock signal CPV is 11.2 ms and an interval, in which black data can be inserted, is approximately 5.5 ms.

However, in the conventional liquid crystal display device as described above, since the gate sequential scanning method has been utilized, the black data can't be inserted during the short time of 5.5 ms even if all gates are driven.

SUMMARY OF THE INVENTION

Accordingly, the present invention has been made to solve the above-mentioned problems occurring in the prior art, and an object of the present invention is to provide a liquid crystal driving device for decreasing active address interval by a predetermined width in comparison to the prior art, increasing a blanking interval and reducing the entire gate driving time in the blanking interval by scanning a plurality of gate bus lines at the same time during the blanking interval.

In order to achieve the above objects, according to one aspect of the present invention, there is provided an impulsive type liquid crystal driving device, comprising: a liquid crystal panel for including a plurality of gate bus lines, which are arranged in one-direction, and a plurality of data bus lines which are arranged in a direction perpendicular to the plurality of gate bus lines; a gate driver section for sequentially scanning the plurality of gate bus lines during an active address interval in response to a second vertical starting signal, a vertical clock signal and an output enable signal, and scanning the plurality of gate bus lines during a vertical blanking interval in a unit of a predetermined number of lines; and a current boosting section for increasing current amount supplied to the gate bus lines during the vertical blanking interval in response to a pulse width modulation signal.

The preferred embodiments will now be described below in detail in reference to the accompanying drawings.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, a preferred embodiment of the present invention will be described with reference to the accompanying drawings.

Figure 1:
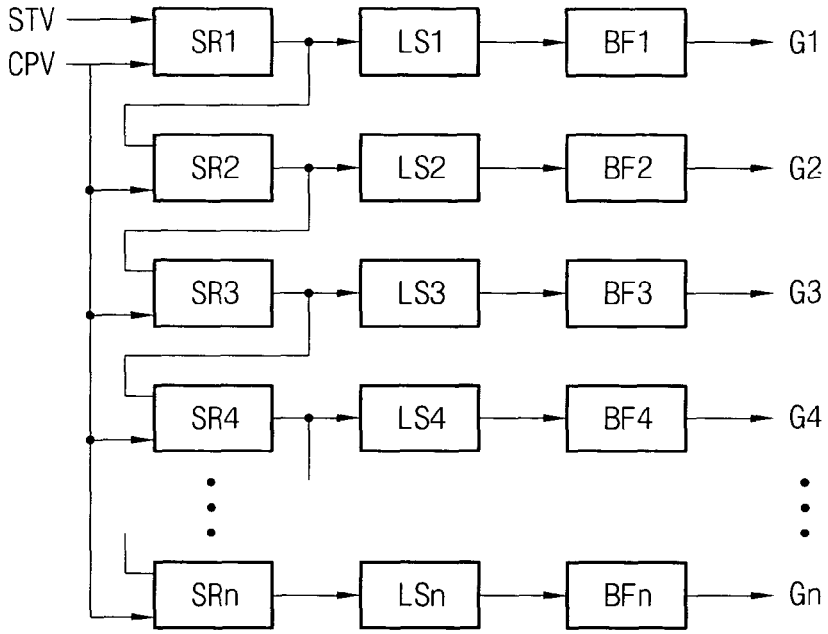
FIG.1 (PRIOR ART)
FIG. 1 is a block diagram showing a construction of a conventional gate driver integrated circuit.
Figure 2:
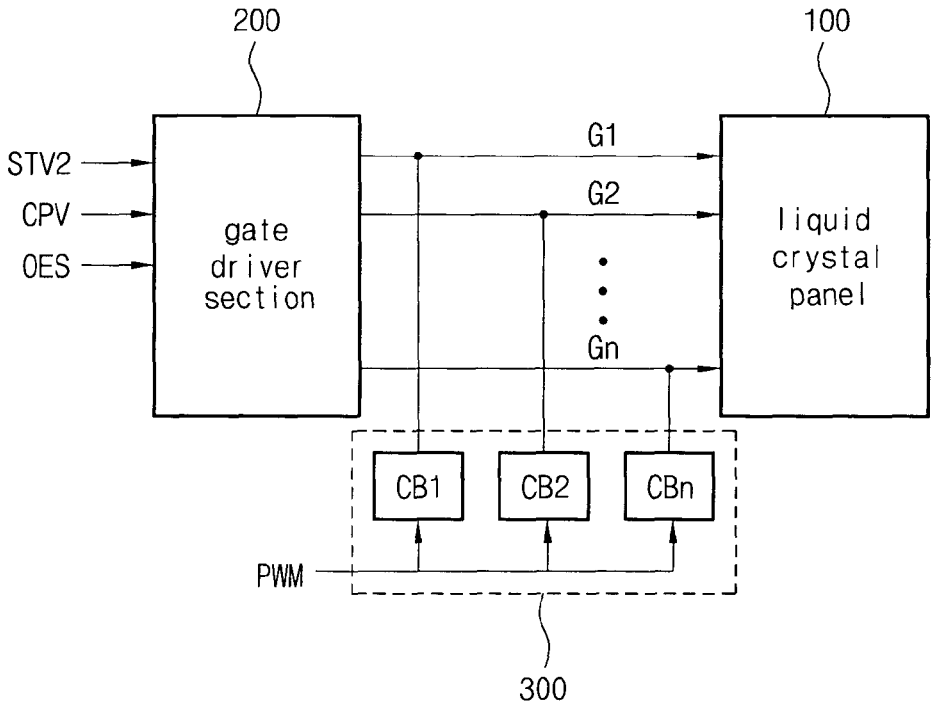
FIG. 2 is a block diagram showing a liquid crystal driving device according to the present invention.

FIG. 2 is a block diagram showing a liquid crystal driving device according to the present invention. As shown in FIG. 2, the liquid crystal driving device comprises a liquid crystal panel 109, a gate driver section 200 and a current boosting section 300.

The liquid crystal panel 100 includes a plurality of gate bus lines (not shown) arranged in one-direction, a plurality of data bus lines (not shown) arranged in a direction perpendicular to the plurality of gate bus lines, and thin film transistors (not shown) formed on intersections of the plurality of gate bus lines and the plurality of data bus lines.

The gate driver section 200 includes a plurality of gate driver Ics and sequentially scans the plurality of gate bus lines during an active address interval in response to a second vertical starting signal STV2, a vertical clock signal CPV and an output enable signal OES. At the same time, the gate driver section 200 scans the plurality of gate bus lines during a vertical blanking interval in a unit of a predetermined number of lines.

The current boosting section 300 includes a plurality of current booster circuits CB1~CBn for receiving a plurality of gate on/off signals G0~Gn outputted from the gate driver section 200 and a pulse width modulation signal PWM, respectively. Further, the current boosting section 300 increases current amount supplied to the gate bus lines during the vertical blanking interval in response to the pulse width modulation signal PWM. Herein, the supplied current amount is adjusted according to a duty ratio of the pulse width modulation signal PWM.

Figure 3:
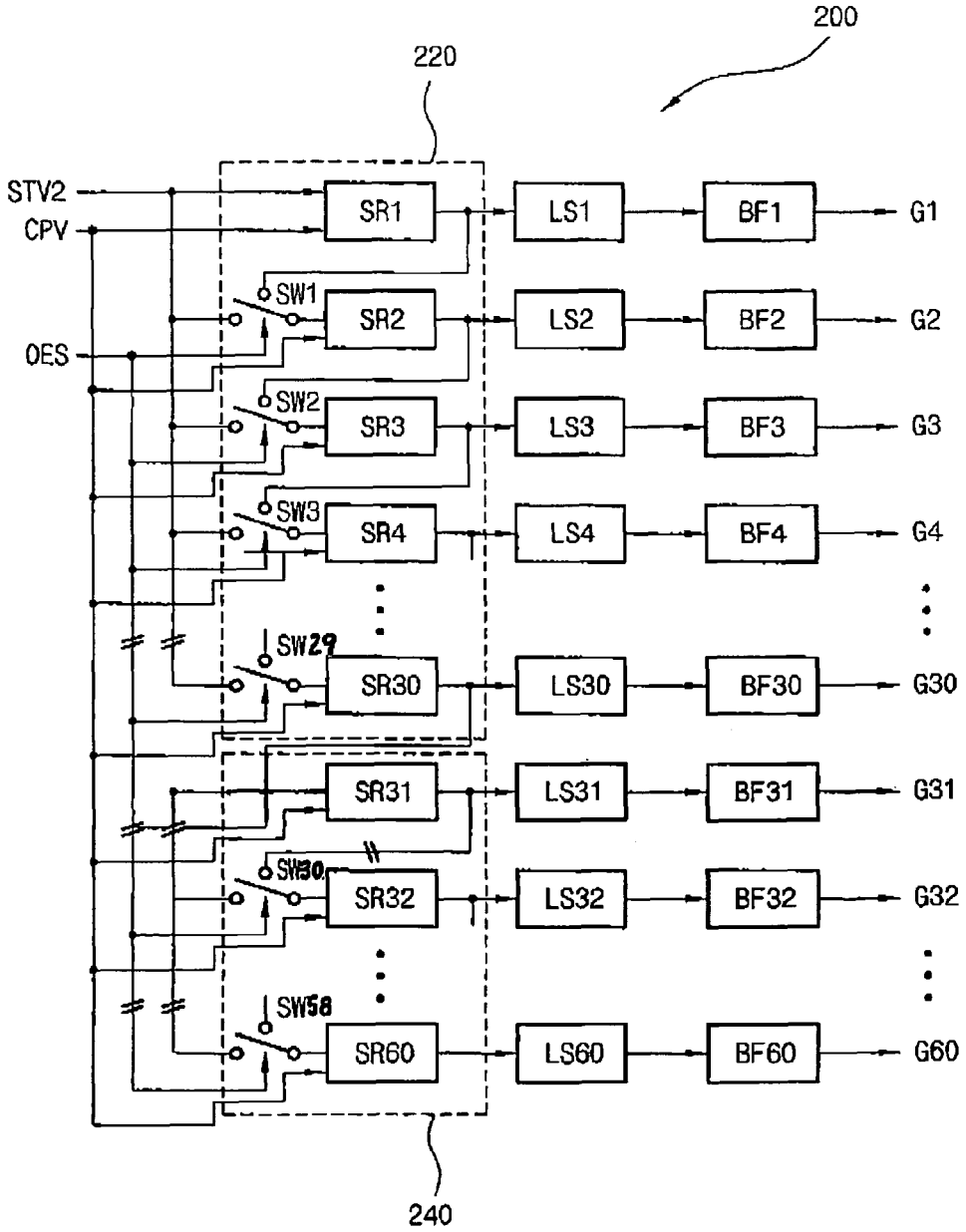
FIG. 3 is a block diagram showing a construction of a gate driver integrated circuit according to the present invention.

FIG. 3 is a block diagram showing a construction of a gate driver integrated circuit according to the present invention. As shown in FIG. 3, the gate driver integrated circuit includes a first shift register section 220, a second shift register section 240, a plurality of level shifters LS1~LSn and a plurality of buffer amplifiers BF1~BFn.

The first shift register section 220 includes a predetermined number of first switches SW1~SW29 and a predetermined number of first shift registers SR1~SR30. The first switches SW1~SW29 are switched by the output enable signal OES and then selects either the second vertical starting signal STV2 or an internally shifted signal. Further, when the internally shifted signal is selected by the switching operation of the predetermined number of first switches SW1~SW29, the first shift registers SR1~SR30 receive the second vertical starting signal STV2 and then output it after sequentially shifting it. Also, when the second vertical starting signal STV2 is selected, the first shift registers SR1~SR30 receive the second vertical starting signal STV2 and then output a predetermined number of first output signals at the same time without shifting.

For instance, the switch SW1 of the first switches SW1~SW29 switches to an output terminal of the shift register SR1 of the first shift registers SR1~SR30 during the active address interval and switches to an input terminal of the second vertical starting signal STV2 during the vertical blanking interval. Also, the switch SW2 of the first switches SW1~SW29 switches to an output terminal of the shift register SR2 of the first shift registers SR1~SR30 during the active address interval and switches to an input terminal of the second vertical starting signal STV2 during the vertical blanking interval.

In order to sequentially scan a predetermined number of gate bus lines during the active address interval in response to the vertical clock signal CPV and the output enable signal OES, the first shift register section 220 having such construction outputs the second vertical starting signal STV2 after sequentially shifting it. Further, in order to scan the predetermined number of gate bus lines at the same time during the vertical blanking interval, the first shift register section 220 receives the second vertical starting signal STV2 and then generates a predetermined number of first output signals at the same time.

The second shift register section 240 includes a predetermined number of second switches SW31~SR60 and a predetermined number of second shift registers SR31~SR60. The second switches SW31~SW60 are switched by the output enable signal OES and then selects either the second vertical starting signal STV2 or an internally shifted signal. Further, when the internally shifted signal is selected by the switching operation of the predetermined number of second switches SW31~SW60, the second shift registers SR31~SR60 receive the second vertical starting signal STV2 and then output it after sequentially shifting it. Also, when the second vertical starting signal STV2 is selected by the switching operation of the predetermined number of second switches SW31~SW60, the second shift registers SR31~SR60 receive the second vertical starting signal STV2 and then output a predetermined number of second output signals at the same time without shifting.

For instance, the switch SW31 of the second switches SW31~SW60 switches to an output terminal of the shift register SR31 of the second shift registers SR31~SR60 during the active address interval and switches to an input terminal of the shift register SR30 of the first shift register section 220 during the vertical blanking interval. Also, the switch SW32 of the second switches SW31~SW60 switches to an output terminal of the shift register SR32 of the second shift registers SR31~SR60 during the active address interval and switches to an input terminal of the shift register SR30 of the first shift register section 220 during the vertical blanking interval.

In order to sequentially scan a predetermined number of gate bus lines during the active address interval in response to the vertical clock signal CPV, the second shift register section 240 having such construction receives a shifted signal by the shift register SR30 of the first shift register section 220 and then outputs it through the shift registers SR31~SR60 after sequentially shifting it. Further, in order to scan the predetermined number of gate bus lines at the same time during the vertical blanking interval, the second shift register section 240 receives the shifted signal by the shift register SR30 of the first shift register section 220 and then outputs a predetermined number of output signals at the same time through the shift registers SR31 SR60.

The plurality of level shifters LS1~LS60 are coupled to the shift registers SR1~SR30 of the first shift register section 220 and the shift registers SR31~SR60 of the second shift register section 240, respectively. The level shifters LS1~LS60 level-convert output signals of the shift registers SR1~SR30 and the shift registers SR31~SR60 and then output the level-converted signals to the plurality of buffer amplifiers BF1~BF60.

The plurality of buffer amplifiers BF1~BF60 are coupled to the plurality of level shifters LS1~LS60 respectively, amplify the signals converted by the plurality of level shifters LS1~LS60 and then generate gate on/off signals G1~G60.

The gate driver IC applied to the present invention sequentially drives the gate bus lines during the active interval. Also, the gate driver IC drives the gate bus lines from the first to the thirtieth at the same time and then drives the gate bus lines from the thirty first to the sixtieth at the same time during the vertical blanking interval.

When it is driven in a unit of 30 gate bus lines in such a way, the gate on time decreases to one thirtieth in comparison to the prior art. Therefore, black data can be inserted within the vertical blanking interval, which is relatively shorter than the active address interval.

Also, when a plurality of gate bus lines are driven during the vertical blanking interval differently from the case of the active address interval, the gate bus lines momentarily require a large current. Accordingly, in order to supply a correspondingly large current, the present invention utilizes a current booster circuit.

Figure 4:
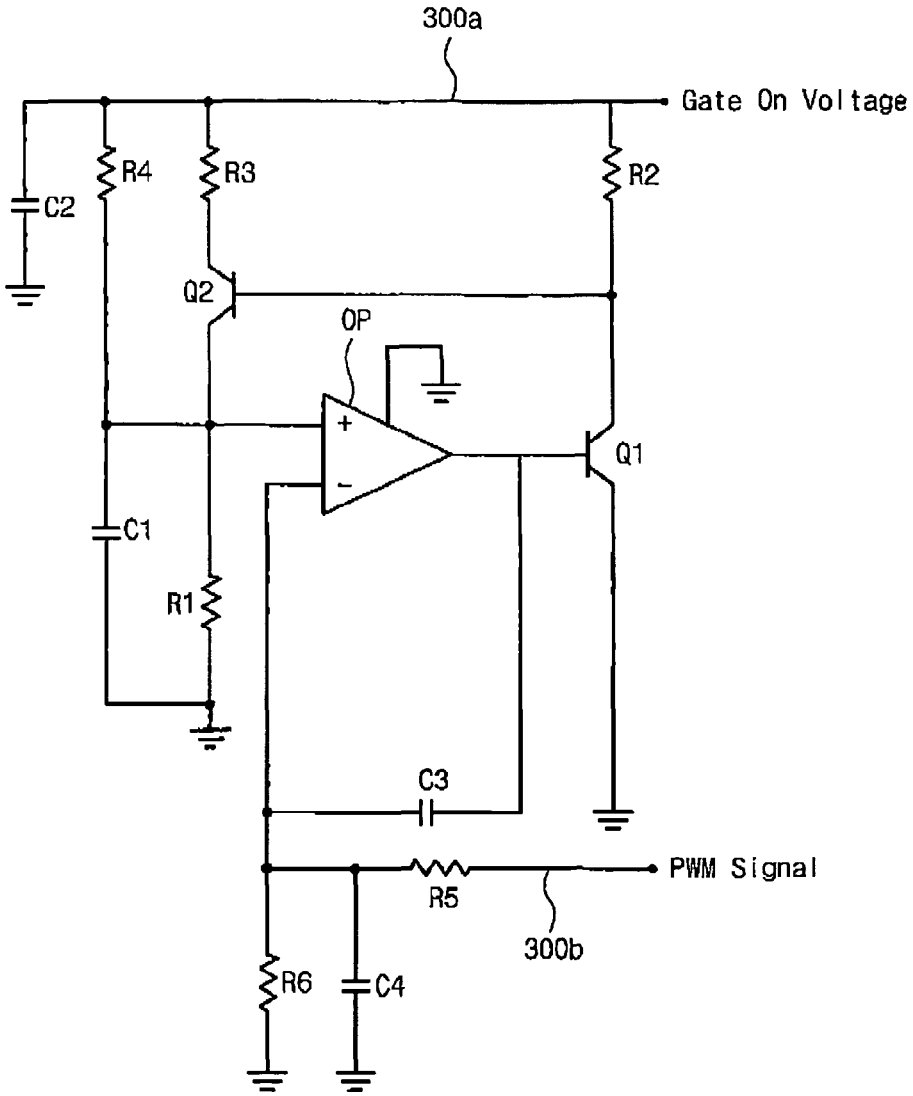
FIG. 4 is a detailed circuit diagram showing a current booster circuit according to the present invention.

FIG. 4 is a detailed circuit diagram showing a current booster circuit according to the present invention. As shown in FIG. 4, the current booster circuit includes an operational amplifier OP having a non-inverting terminal (+) and an inverting terminal (−), a first resistor R1 coupled between the non-inverting terminal (+) and a ground, a first capacitor C1 coupled in parallel to the first resistor R1, a second capacitor C2 coupled between a first input terminal 300*a* and the ground, a second resistor R2, of which one end is coupled to the first input terminal 300*a*, a first bipolar transistor Q1, which is coupled between the other end of the second resistor R2 and a ground, and is turned on according to an output signal of the operational amplifier OP, a third resistor R3, of which one end is coupled to the first input terminal 300*a*, a second bipolar transistor Q2, which is coupled between the other end of the third resistor R3 and the non-inverting terminal (+), and is turned on according to an output signal of the other end of the second resistor R2, a fourth resistor R4 coupled between the first input terminal 300*a* and the non-inverting terminal (+), a third capacitor C3 coupled between the inverting terminal (−) of the operational amplifier OP and an output terminal, a fifth resistor R5 coupled between a second input terminal 300*b* and the inverting terminal (−), a sixth resistor R6 coupled between the inverting terminal (−) and a ground, and a fourth capacitor C4 coupled in parallel to the sixth resistor R6.

Figure 5:
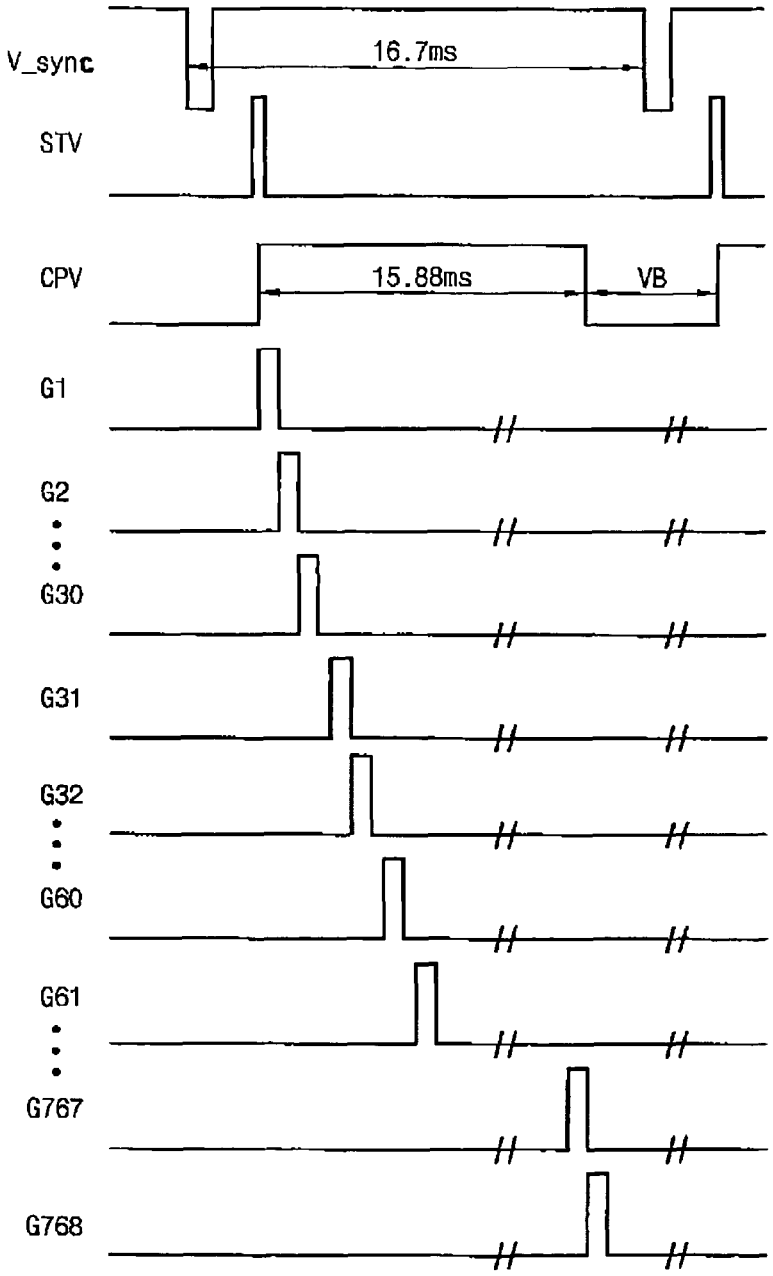
FIG. 5 is a timing chart showing a scanning timing of a gate bus line in normal operation according to the present invention.

FIG. 5 is a timing chart showing a scanning timing of a gate bus line in normal operation according to the present invention. As shown in FIG. 5, a V_sync represents a vertical sync, a STV represents a first vertical starting signal, a CPV represents a vertical clock signal and G1 to G768 represent gate on/off signals respectively.

According to the present invention, when TV image signals such as NTSC and PAL have been driven at 60 Hz and then 768 gate bus lines have been scanned in normal operation mode, an interval of one frame is fixed as 16.7 ms, the vertical clock signal CPV is enabled during 15.88 ms and the 768 gate bus lines are sequentially scanned within the enabled interval of the vertical clock signal, as shown in FIG. 5.

Figure 6:
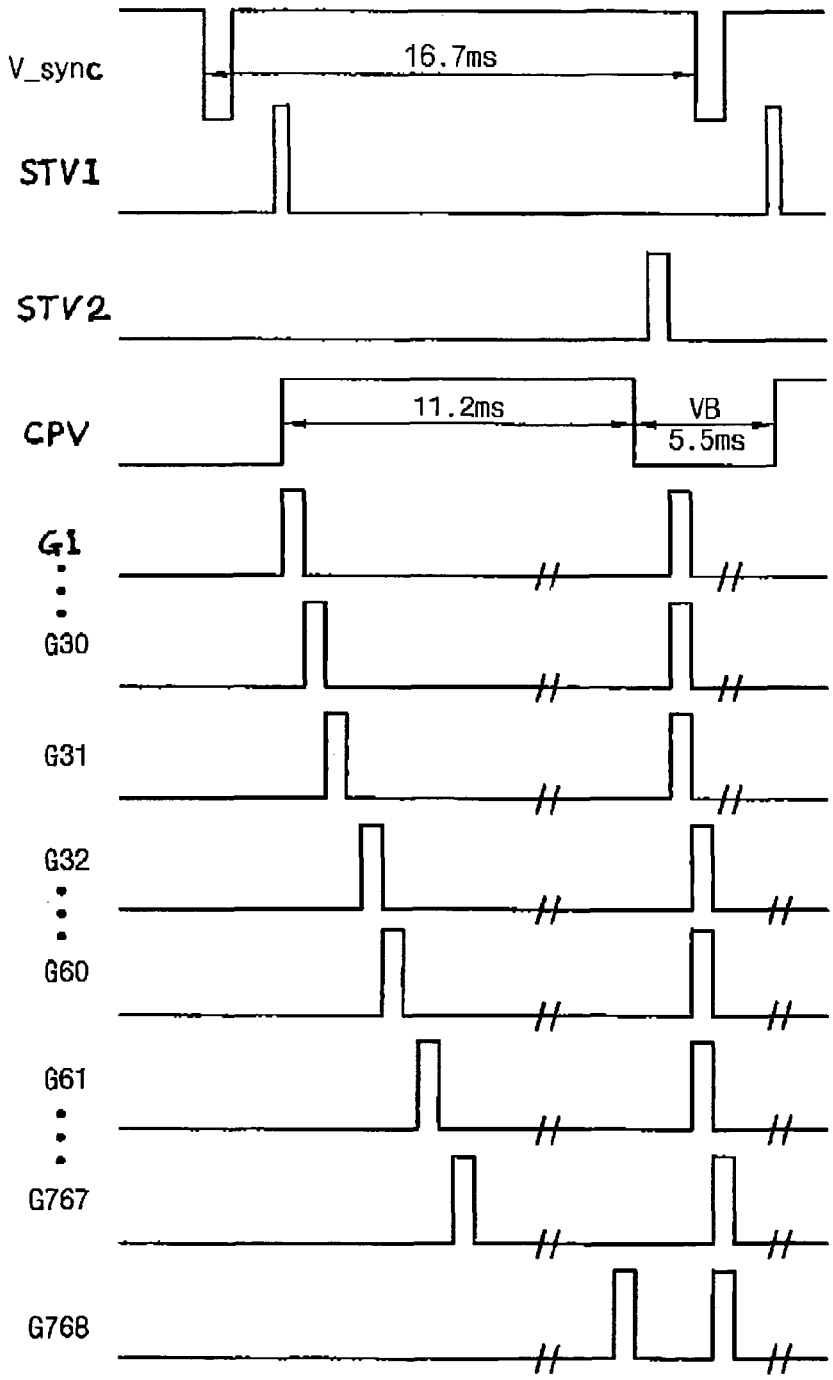
FIG. 6 is a timing chart showing a scanning timing of a gate bus line in blink operation according to the present invention.

FIG. 6 is a timing chart showing a scanning timing of a gate bus line in blink operation according to the present invention.

According to the present invention, when TV image signals such as NTSC and PAL have been driven at 60 Hz and then 768 gate bus lines have been scanned in blink operation mode, an interval of one frame is fixed as 16.7 ms, the vertical clock signal CPV is enabled during 11.2 ms. Further, a vertical blanking interval VB is maintained at 5.5 ms and increases in comparison to the existing vertical blanking interval, as shown in FIG. 6. When the second vertical starting signal STV2 is activated within the blanking interval, 30 gate lines are selected and next 30 lines are selected sequentially to the end of gate line in a unit of 30 lines. In this case, the time taken for scanning all of 768 gate bus lines is about 0.73 ms. For instance, when 100 lines are driven at the same time, only 0.2 ms is needed.

Accordingly, in the present invention, since black data can be sufficiently inserted within the vertical blanking interval, the occurrence of the blurring phenomenon can be removed.

Figure 7:
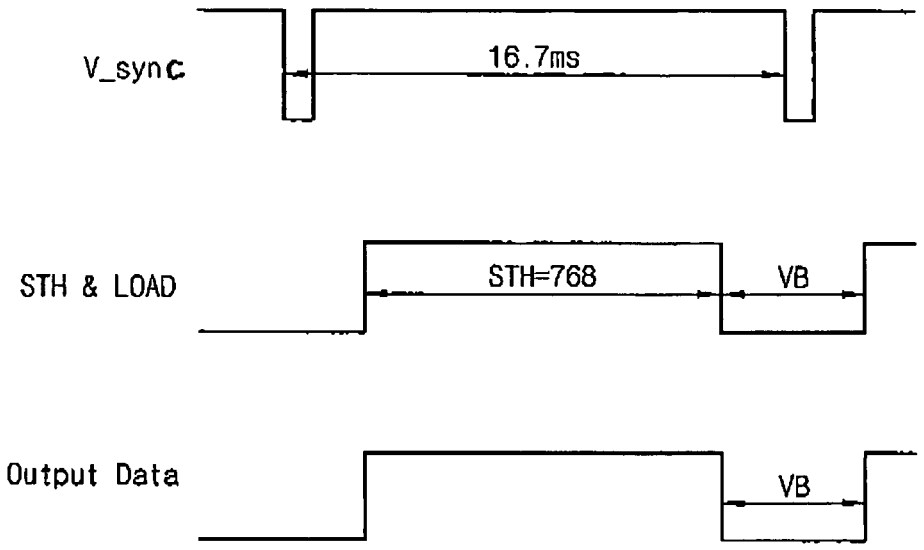
FIG. 7 is a timing chart showing a driving timing of a date bus line in normal operation according to the present invention.
Figure 8:
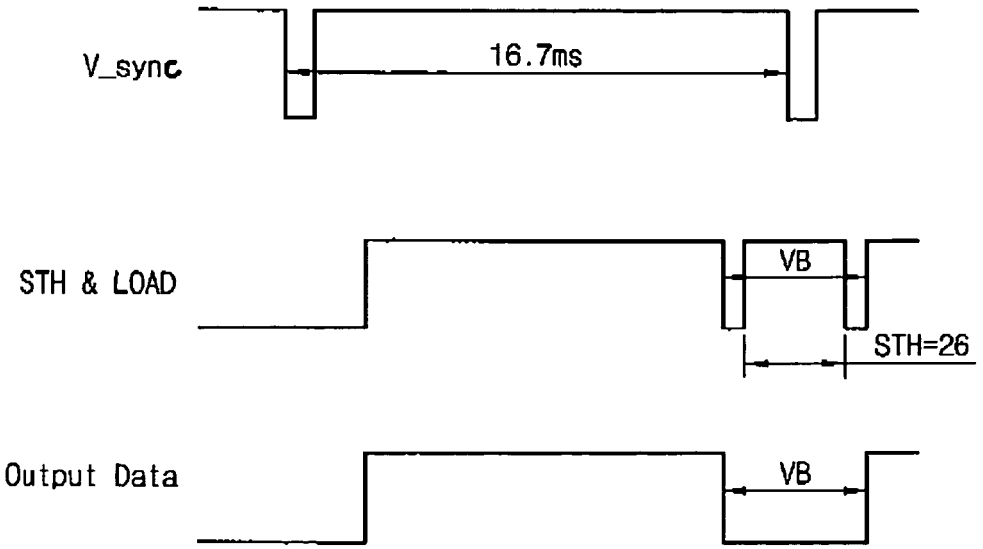
FIG. 8 is a timing chart showing a driving timing of a date bus line in blink operation according to the present invention.

FIG. 7 is a timing chart showing a driving timing of a date bus line in normal operation according to the present invention and FIG. 8 is a timing chart showing a driving timing of a date bus line in blink operation according to the present invention.

As known in FIG. 7, 768 horizontal starting signals STH are generated within an enabled interval of the horizontal starting signal STH.

As known in FIG. 8, 26 horizontal starting signals STH are generated within a vertical blanking interval VB.

Figure 9:
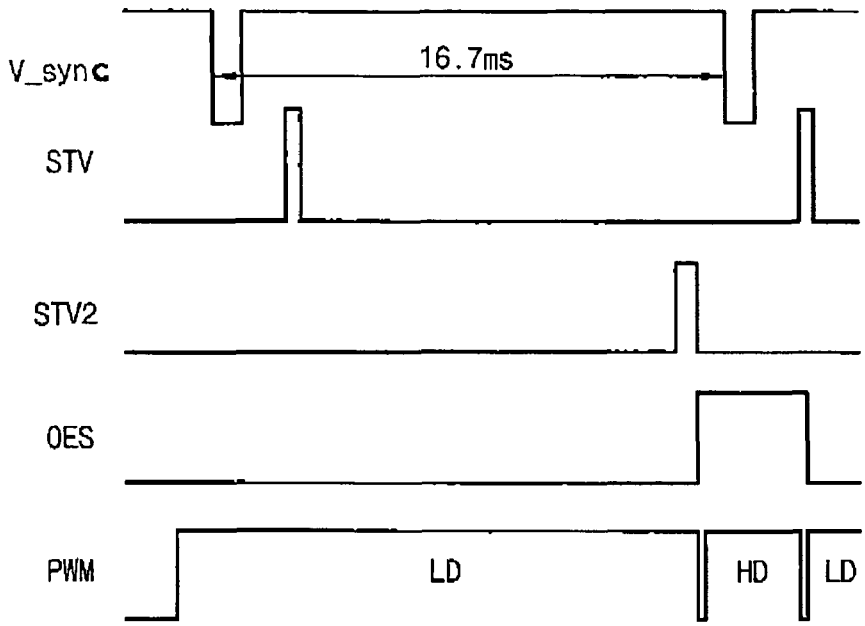
FIG. 9 is a timing chart showing an operation timing of a current booster circuit according to the present invention.

FIG. 9 is a timing chart showing an operation timing of a current booster circuit according to the present invention. As shown in FIG. 9, a pulse width modulation signal PWM maintains a low duty ratio LD within one frame interval of a vertical sync and maintains a high duty ratio HD within a vertical blanking interval.

As describe above, according to the present invention, an active address interval decreases by a predetermined width in comparison to the prior art, a blanking interval, in which black data is inserted, increases and a plurality of gate bus lines are scanned at the same time during the blanking interval, so as to reduce entire gate driving time in the blanking interval, thereby not only greatly decreasing the occurrence possibility of EMI in the active address interval but also increasing the data maintenance time of a liquid crystal.

The preferred embodiment of the present invention has been described for illustrative purposes, and those skilled in the art will appreciate that various modifications, additions and substitutions are possible, without departing from the scope and spirit of the invention as disclosed in the accompanying claims.

What is claimed is:

1. An impulsive type liquid crystal driving device, comprising:

a liquid crystal panel comprising:

a plurality of gate bus lines arranged in a first direction; and a plurality of data bus lines arranged in a second direction substantially perpendicular to the first direction;

a gate driver section for sequentially scanning the plurality of gate bus lines during an active address interval in response to a vertical starting signal, a vertical clock signal, and an output enable signal and for scanning the plurality of gate bus lines during a vertical blanking interval in a unit of a predetermined number of lines; and a current boosting section for increasing current amount supplied to the gate bus lines during the vertical blanking interval in response to a pulse width modulation signal, wherein the supplied current amount is adjustable according a duty ratio of the pulse width modulation signal, and wherein the current boosting section comprises:

a plurality of current booster circuits for receiving a plurality of gate on/off signals outputted from the gate driver section and a pulse width modulation signal, respectively;

an operational amplifier having a non-inverting terminal and an inverting terminal;

a first resistor coupled between the non-inverting terminal and a ground;

a first capacitor coupled in parallel to the first resistor;

a second capacitor coupled between a first input terminal and the ground;

a second resistor of which one end is coupled to the first input terminal;

a first bipolar transistor coupled between the other end of the second resistor and a ground, and turned on according to an output signal of the operational amplifier;

a third resistor of which one end is coupled to the first input terminal;

a second bipolar transistor coupled between other end of the third resistor and the non-inverting terminal, and turned on according to an output signal of other end of the second resistor;

a fourth resistor coupled between the first input terminal and the non-inverting terminal;

a third capacitor coupled between the inverting terminal of the operational amplifier and an output terminal;

a fifth resistor coupled between a second input terminal and the inverting terminal;

a sixth resistor coupled between the inverting terminal and a ground; and a fourth capacitor coupled in parallel to the sixth resistor.

2. The liquid crystal driving device according to claim 1, wherein the gate driver section comprises a plurality of gate driver integrated circuits for scanning the plurality of gate bus lines in response to the second vertical starting signal, the vertical clock signal, and the output enable signal.

3. The liquid crystal driving device according to claim 2, wherein each of the gate driver integrated circuit comprises:

a first shift register section which sequentially shifts the vertical starting signal and ouputs the shifted vertical starting signal during the active address interval, and which generates a predetermined number of first output signals at substantially the same time the shifted vertical starting signal is outputted after receiving the vertical starting signal during the vertical blanking interval, in response to the vertical clock signal and the output enable signal;

a second shift register section which receives the signal shifted by the first shift register section, sequentially shifts the received signal, and then outputs shifted received signal during the active address interval, and which generates a predetermined number of second output signals at substantially the same time the shifted received signal is outputted after receiving the signal shifted by the first shift register section during the vertical blanking interval, in response to the vertical clock signal;

a plurality of level shifters which level-convert the output signals of the first and the second shift register section; and a plurality of buffer amplifiers which amplify the signals converted by the plurality of level shifters and then generates gate on/off signals.

4. The liquid crystal driving device according to claim 3, wherein the first shift register section comprises:

a predetermined number of first switches which select either the vertical starting signal or an internally shifted signal in response to the output enable signal; and a predetermined number of first shift registers which receive the vertical starting signal and then output it after sequentially shifting it, when the internally shifted signal is selected, and which receive the vertical starting signal and then output the predetermined number of first output signals at the same time without shifting, when the vertical starting signal is selected.

5. The liquid crystal driving device according to claim 3, wherein the second shift register section includes:

a plurality of second switches which select either the signal shifted by the first shift register section or an internally shifted signal in response to the output enable signal; and a predetermined number of second shift registers which receive the vertical starting signal and then output it after sequentially shifting it, when the internally shifted signal is selected, and which receive the shifted signal and then output the predetermined number of second output signals at the same time without shifting, when the signal shifted by the first shift register section is selected.

6. The liquid crystal driving device according to claim 1, wherein the first and the second first bipolar transistor are p-type transistors.

7. The liquid crystal driving device according to claim 1, wherein the current amount generated in the current boosting section is adjusted according to a duty ratio of the pulse width modulation signal.

* * * * *